US011021302B2

(12) United States Patent
Edie et al.

(10) Patent No.: US 11,021,302 B2
(45) Date of Patent: Jun. 1, 2021

(54) CLOSURE WITH ROTATION-INHIBITING PROJECTION

(71) Applicant: CLOSURE SYSTEMS INTERNATIONAL INC., Memphis, TN (US)

(72) Inventors: John C. Edie, Linden, IN (US); Thomas McCandless, Crawfordsville, IN (US); William Moll, Bloomingdale, IN (US)

(73) Assignee: Closure Systems International Inc., Indianapolis, IN (US)

( * ) Notice: Subject to any disclaimer, the term of this patent is extended or adjusted under 35 U.S.C. 154(b) by 0 days.

(21) Appl. No.: 16/388,522

(22) Filed: Apr. 18, 2019

(65) Prior Publication Data

US 2020/0331663 A1 Oct. 22, 2020

(51) Int. Cl.
*B65D 41/04* (2006.01)

(52) U.S. Cl.
CPC ..... *B65D 41/0471* (2013.01); *B65D 41/0421* (2013.01); *B65D 2251/023* (2013.01); *B65D 2251/06* (2013.01); *B65D 2251/20* (2013.01)

(58) Field of Classification Search
CPC ..... B65D 41/0471; B65D 41/0421; B65D 2251/023; B65D 2251/20; B65D 2251/06
See application file for complete search history.

(56) References Cited

U.S. PATENT DOCUMENTS

| | | | |
|---|---|---|---|
| 2,162,880 | A | 8/1936 | Brown |
| 3,147,876 | A | 9/1964 | Lepore |
| 3,295,708 | A | 1/1967 | Wathen |
| 3,405,831 | A | 10/1968 | Hudson |
| 3,620,400 | A | 11/1971 | Brown |
| 3,682,345 | A | 8/1972 | Baugh |
| 3,741,421 | A | 6/1973 | Wittwer |
| 3,987,921 | A | 10/1976 | Aichinger |
| 4,007,848 | A | 2/1977 | Snyder |
| 4,382,521 | A | 5/1983 | Ostrowsky |
| 4,427,126 | A | 1/1984 | Ostrowsky |
| 4,456,137 | A | 6/1984 | Lyman |
| 4,461,394 | A | 7/1984 | Sendel |

(Continued)

FOREIGN PATENT DOCUMENTS

WO WO 2009/073137 A1 6/2009

OTHER PUBLICATIONS

International Search Report and Written Opinion in International Application No. PCT/US2020/028019, dated Aug. 26, 2020 (12 pages).

*Primary Examiner* — James N Smalley
(74) *Attorney, Agent, or Firm* — Nixon Peabody LLP

(57) ABSTRACT

A closure includes first and second closure portions. The first closure portion includes a polymeric top wall portion and an annular skirt portion. The skirt portion includes exterior and interior surfaces. The interior surface includes an internal thread formation for mating engagement with an external thread formation of a container and at least one rotation-inhibiting projection. The rotation-inhibiting projection is located to contact the external thread formation. The rotation-inhibiting projection is in the general shape of the letter "C" prior to engagement with the external thread formation of the container. The second closure portion includes a polymeric tamper-evident band.

16 Claims, 5 Drawing Sheets

(56) References Cited

U.S. PATENT DOCUMENTS

| | | | | | |
|---|---|---|---|---|---|
| 4,497,765 | A | | 2/1985 | Wilde | |
| 4,674,643 | A | | 6/1987 | Wilde | |
| 4,697,715 | A | | 10/1987 | Beruvides | |
| 4,738,370 | A | | 4/1988 | Urmston | |
| 4,747,502 | A | | 5/1988 | Luenser | |
| 4,978,017 | A | | 12/1990 | McBride | |
| 5,184,741 | A | | 2/1993 | Chevassus | |
| 5,197,620 | A | | 3/1993 | Gregory | |
| 5,205,426 | A | | 4/1993 | McBride | |
| 5,292,020 | A | * | 3/1994 | Narin | B65D 41/0471 215/330 |
| 5,366,774 | A | | 11/1994 | Pinto | |
| 5,676,270 | A | | 10/1997 | Roberts | |
| 5,845,798 | A | | 12/1998 | Carrier | |
| 5,884,790 | A | * | 3/1999 | Seidita | B65D 41/0471 215/252 |
| 6,123,212 | A | | 9/2000 | Russell | |
| 6,889,857 | B2 | | 5/2005 | Francois | |
| 7,637,384 | B2 | | 12/2009 | Price | |
| 8,453,866 | B2 | | 6/2013 | Kamath | |
| 8,485,374 | B2 | | 7/2013 | Gevers | |
| 8,763,380 | B2 | | 7/2014 | Sata | |
| 9,085,385 | B1 | | 7/2015 | Costanzo | |
| 9,126,726 | B2 | | 9/2015 | Edie | |
| 2006/0255003 | A1 | * | 11/2006 | Fuchs | B65D 41/0421 215/252 |
| 2009/0045158 | A1 | | 2/2009 | Suriol | |
| 2017/0349336 | A1 | | 12/2017 | Sadiq | |
| 2018/0009979 | A1 | | 1/2018 | Nishiyama | |

* cited by examiner

CLOSURE WITH ROTATION-INHIBITING PROJECTION

FIELD OF THE INVENTION

The present invention relates generally to a polymeric closure for a package. More specifically, the present invention relates to a polymeric closure with at least one rotation-inhibiting projection.

BACKGROUND OF THE INVENTION

Polymeric closures have been used in many applications over the years in conjunction with containers. The polymeric closures are adapted to thread on and off of the container. One issue with polymeric closures in this area is controlling the speed of the unthreading of the closure from the container by a user. This is typically more important in applications having pressurized container contents such as carbonated soft drinks.

One application for controlling the speed of the unthreading of the closure from the container involves using a speed bump. The problem with using existing larger speed bumps is the possibility of the closure or container getting distorted during application or removal due to a variety of factors that influence how the closure and container interact. In some processes, existing larger speed bumps may also potentially flash material onto a finish of the container that may affect the release of the closure from a mold. Having speed bumps being smaller is typically not as effective since the drag on the finish thread is lessened, resulting in the unthreading being faster than desired.

It would be desirable to provide a closure that addresses these above-noted situations, while still performing other desirable properties of a closure.

SUMMARY

According to one embodiment, a closure includes a first closure portion and a second closure portion. The first closure portion includes a polymeric top wall portion. The polymeric annular skirt portion depends from the polymeric top wall portion. The annular skirt portion includes an exterior surface and an interior surface. The interior surface of the annular skirt portion includes (a) an internal thread formation for mating engagement with an external thread formation of a container and (b) at least one rotation-inhibiting projection. The at least one rotation-inhibiting projection is located to contact the external thread formation of the container. The at least one rotation-inhibiting projection is in the general shape of the letter "C" prior to engagement with the external thread formation of the container. The second closure portion includes a polymeric tamper-evident band. The tamper-evident band depends from and is at least partially detachably connected to the polymeric annular skirt portion by a frangible connection. The closure has an unopened position and an opened position. The opened position occurring when the tamper-evident band has been at least partially broken from the polymeric annular skirt portion.

According to another embodiment, a closure includes a first closure portion and a second closure portion. The first closure portion includes a polymeric top wall portion and a polymeric annular skirt portion depending from the polymeric top wall portion. The annular skirt portion includes an exterior surface and an interior surface. The interior surface of the annular skirt portion includes (a) an internal thread formation for mating engagement with an external thread formation of a container and (b) at least one rotation-inhibiting projection. The at least one rotation-inhibiting projection is located to contact the external thread formation of the container. The at least one rotation-inhibiting projection includes a first projection, a second projection and a valley located between the first and second projections prior to engagement with the external thread formation of the container. The projections extend from the interior surface of the annular skirt portion. The second closure portion includes a polymeric tamper-evident band. The tamper-evident band depends from and is at least partially detachably connected to the polymeric annular skirt portion by a frangible connection. The closure has an unopened position and an opened position. The opened position occurs when the tamper-evident band has been at least partially broken from the polymeric annular skirt portion.

According to one method, a package is formed. A closure is provided including a first closure portion and a second closure portion. The first closure portion includes a polymeric top wall portion and a polymeric annular skirt portion depending from the polymeric top wall portion. The annular skirt portion includes an exterior surface and an interior surface. The interior surface of the annular skirt portion includes (a) an internal thread formation for mating engagement with an external thread formation of a container and (b) at least one rotation-inhibiting projection. The at least one rotation-inhibiting projection is located to contact the external thread formation of the container. The second closure portion includes a polymeric tamper-evident band. The tamper-evident band depends from and is at least partially detachably connected to the polymeric annular skirt portion by a frangible connection. The closure has an unopened position and an opened position. The opened position occurs when the tamper-evident band has been at least partially broken from the polymeric annular skirt portion. A container is provided. The container includes a neck portion having the external thread formation. The external thread formation includes a first finish lead such that interference is formed by the surface area of the at least one rotation-inhibiting projection and a surface area of the first finish lead. The total amount of interference between a surface area of the at least one rotation-inhibiting projection and a surface area of the first finish lead is less than about 30%. The closure and the container are threaded to form the package.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1:
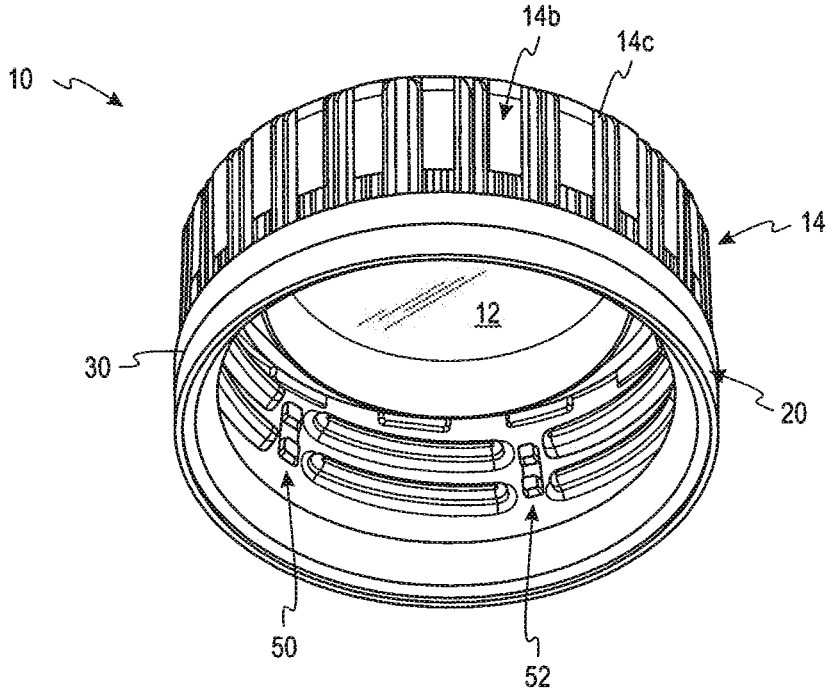
FIG. 1 is a bottom perspective view of a closure in an unopened position according to one embodiment.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

FIG. 1 illustrates a polymeric closure 10 according to one embodiment of the present invention. The closures are configured to be placed on a container or bottle that contain product. The product is typically a liquid product, but also may be a solid product or a combination of a liquid and solid product. The polymeric closure 10 of FIG. 1 is generally cylindrically shaped. The polymeric closure 10 of FIG. 1 is a one-piece closure assembly. It is contemplated that the closure may be a two-piece closure. It is contemplated that the closure may be of other shapes and dimensions.

Figure 2:
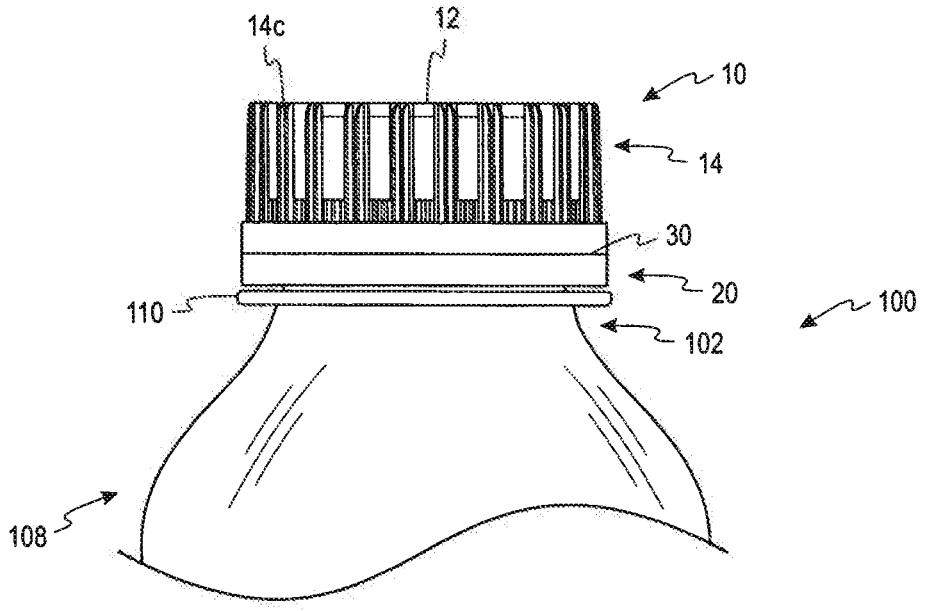
FIG. 2 is a front view of a package including the closure of FIG. 1 and a container according to one embodiment.
Figure 3:
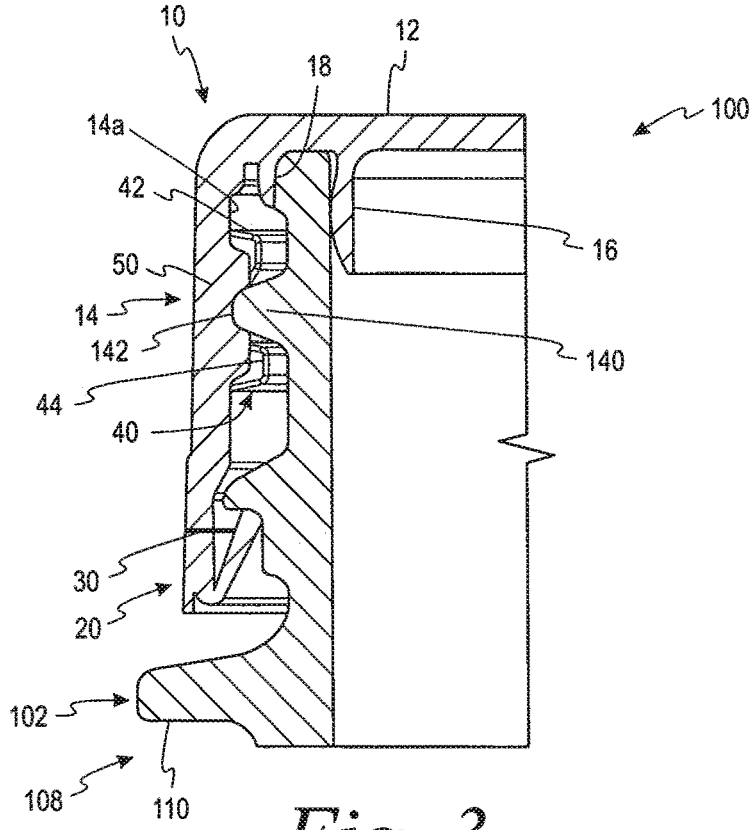
FIG. 3 is a generally cross-sectional partial side view of the package of FIG. 2.

Referring to FIGS. 1-3, the polymeric closure 10 includes a polymeric top wall portion 12, a polymeric annular skirt portion 14, a polymeric continuous plug seal 16 (FIG. 3), an outer seal 18 (FIG. 3) and a polymeric tamper-evident band 20. The polymeric annular skirt portion 14 depends from the polymeric top wall portion 12.

As shown in FIG. 3, the polymeric continuous plug seal 16 depends from the polymeric top wall portion 12 and provides a sealing mechanism. The outer seal 18 depends from the polymeric top wall portion 12 and also provides a sealing mechanism. The continuous plug seal 16 and the outer seal 18 are spaced from an interior surface 14*a* of the polymeric annular skirt portion 14.

In another embodiment, the closure may include other sealing mechanisms. For example, the closure may include a polymeric lining material that provides a seal to the closure. This would be a two-piece closure. Non-limiting examples of a closure including a polymeric liner and a polymeric disk can be found at U.S. Publication No. 2018/0099795, which is incorporated by reference herein in its entirety. In this embodiment, the closure would be formed from separate components, but would function as the one-piece closure discussed except with a different sealing mechanism. In another embodiment, the closure may include either a polymeric outer seal or a continuous plug seal. It is contemplated that the closure may include other sealing mechanisms.

As shown in, for example, FIGS. 1-3, the polymeric tamper-evident band 20 depends from and is at least partially detachably connected to the polymeric annular skirt portion 14 by a frangible connection 30. Once the closure moves from an initial closed position (see, e.g., FIG. 2) to an open position, the polymeric tamper-evident band 20 is at least partially detached and typically is fully detached from the polymeric annular skirt portion 14. The tamper-evident band 20 works in conjunction with the container to indicate to a user that the contents of the container may have been accessed. More specifically, the tamper-evident band 20 is designed to at least partially separate from the annular skirt portion 14 if a user opens the package by unthreading and removing the closure to gain access to the container. In one embodiment, the frangible connection 30 may be formed using scoring or scored lines, notches, leaders, nicks or other lines of weaknesses.

Referring back to FIG. 1, an outer surface 14*b* of the polymeric annular skirt portion 14 may also include a plurality of ridges 14*c* thereon. The plurality of ridges 14*c* has a contoured shape that assists a user in gripping the closure 10.

The polymeric annular skirt portion includes an internal thread formation for mating engagement with an external thread formation of a container. Specifically, the polymeric annular skirt portion 14 of FIG. 3 includes an internal thread formation 40 for mating engagement with an external thread formation of a container. The internal thread formation 40 includes a first closure thread segment 42 and a second closure thread segment 44. The thread development is typically discontinuous. The thread segments in the polymeric annular skirt portion 14 from the beginning to the end are helical in this embodiment.

There may be applications where there are not multiple thread segments in the closure, but they are typically used for packages holding less than 45 psi. It is contemplated that the thread closure turns may be continuous, especially in those applications with packages having less than 45 psi. It is also contemplated that the internal thread formation of the closure may differ from a helical thread formation. It is also contemplated that other internal thread formations may be used in the closure.

Figure 4:
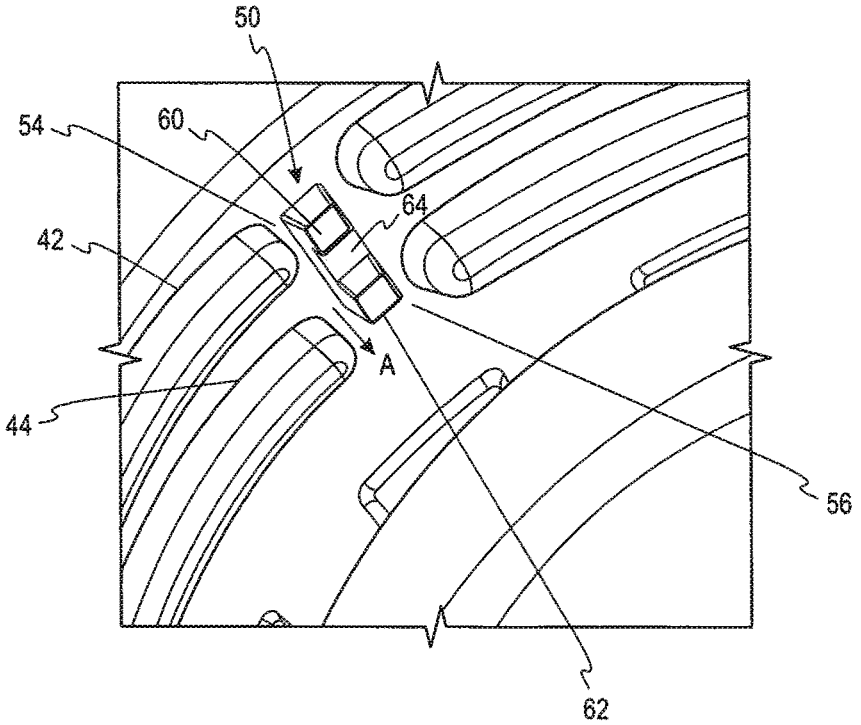
FIG. 4 is a generally top perspective view of a rotation-inhibiting projection of the closure of FIG. 1 according to one embodiment.
Figure 5A:
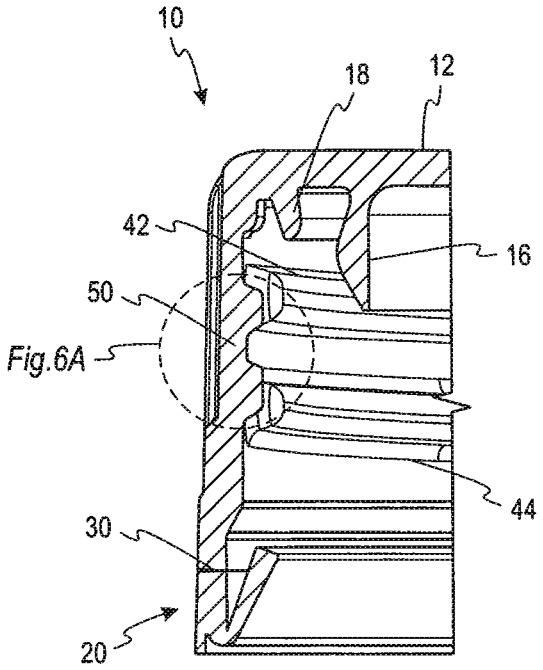
FIG. 5A is a cross-sectional partial side view taken along a rotation-inhibiting projection of the closure of FIG. 1 before being threaded onto a container.

Referring to FIGS. 4 and 5A, a rotation-inhibiting projection or speed bump 50 is shown according to one embodiment. The rotation-inhibiting projection 50 of FIG. 4 is shown as being located between gaps or spaces 54, 56 between the first closure thread segment 42 and the second closure thread segment 44, respectively. The rotation-inhibiting projection is also located in a generally axially direction (direction of arrow A in FIG. 4) with respect to the first closure thread segment 42 and the second closure thread segment 44. The rotation-inhibiting projection 50 is positioned to contact a finish thread of a container when the closure is threaded onto or unthreaded from the container.

The function of the rotation-inhibiting projection 50 is to form a slight resistance during the unthreading of the closure from the container by a user. The rotation-inhibiting projection 50 assists in preventing or inhibiting the closure from spinning quicker than desired. This is especially desired in instances where the contents of the container are pressurized such as carbonated soft drinks.

FIGS. 4 and 5A depict exactly one rotation-inhibiting projection 50. It is contemplated that a plurality of rotation-inhibiting projections may be used in one embodiment. The number of rotation-inhibiting projections used in a closure generally varies from about 1 to about 10. More specifically, the number of rotation-inhibiting projections used in a closure is generally from about 2 to about 8, from about 2 to about 6 or, more specifically, from about 4 to about 6. In one non-limiting example, FIG. 1 depicts a closure 10 with two rotation-inhibiting projections 50, 52 being shown and four other rotation-inhibiting projections not been shown. The rotation-inhibiting projections are shown in vent locations in the thread development. Thus, in closure 10 of FIG. 1, there are a total of six rotation-inhibiting projections.

Figure 6A:
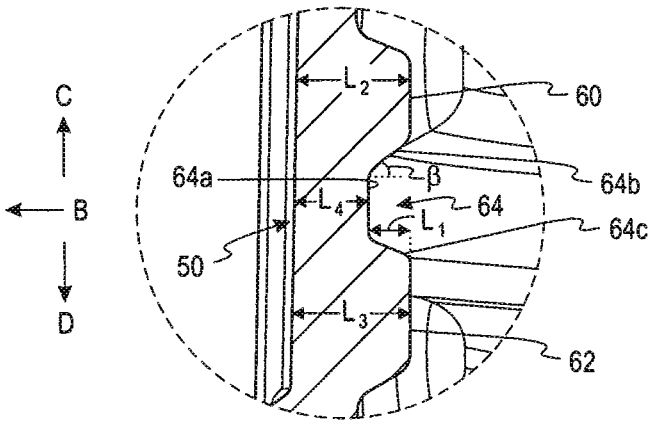
FIG. 6A is an enlarged view of generally circular area FIG. 6A in FIG. 5A.

The shape of the rotation-inhibiting projection 50 shown in FIGS. 4, 5A, 6A is the shape before the closure 10 is threaded onto a container. The process of threading the closure on a container typically occurs via machinery. During the process of threading the closure on the container, the material forming the rotation-inhibiting projection 50 will be conformed generally around the finish thread of the container.

Figure 5B:
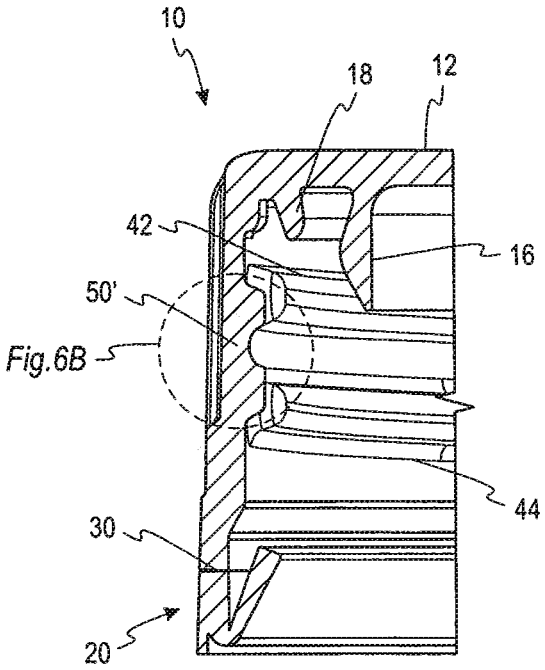
FIG. 5B is a cross-sectional partial side view taken along a rotation-inhibiting projection of the closure of FIG. 1 after being threaded onto a container.
Figure 6B:
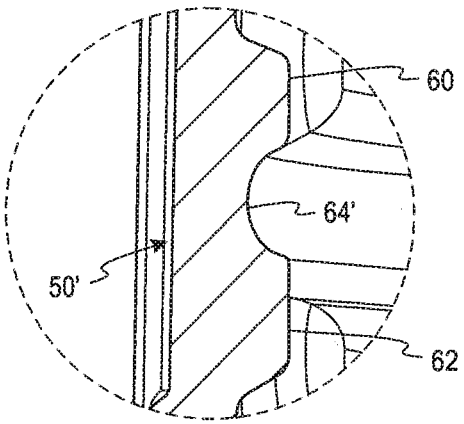
FIG. 6B is an enlarged view of generally circular area FIG. 6B in FIG. 5B.

The rotation-inhibiting projection 50' is shown in FIGS. 5B and 6B after the closure has been threaded onto the container. The shape of valley 64' is slightly more rounded as compared to the valley 64 in FIG. 6A. The valley 64' is shaped by the finish thread as the closure 10 has been threaded onto the container. Once fully applied, the rotation-inhibiting projection looks like the thread has gone through it.

Referring back to FIGS. 4 and 6A, the rotation-inhibiting projection 50 includes a first projection 60, a second projection 62 and a valley 64 between the first and second projections 60, 62. The valley 64 is generally aligned to contact the finish thread of the container when the closure is being threaded onto the container. The shape of the valley 64 is desirably similar to the shape of the finish thread of the container. This assists in both threading on the closure to the container and also allows the finish thread to travel through at a desired resistance while still maintaining a desired contact with the closure thread during the unthreading process. The shape and size of the rotation-inhibiting projection desirably prevents or inhibits the closure from spinning too quickly (spinning without manual resistance) during the unthreading of the closure from the container. The shape and size also reduces or inhibits damage to either the closure or the container.

Referring specifically to FIG. 6A, the valley 64 includes surfaces 64*a*, 64*b*, 64*c* that are integrally connected with each other. The valley 64 is in a general "U" shape. The surfaces 64*b*, 64*c* of FIG. 6A extend generally inwardly to the surface 64*a* as shown in FIG. 6A. In other words, the surfaces 64*b*, 64*c* extend into the interior of the closure and in the direction of arrow B. The surface 64*b* flares upwardly with respect to the surface 64*a* (direction of arrow C in FIG. 6A), while the surface 64*c* flares downwardly with respect to the surface 64*a* (direction of arrow D in FIG. 6A). The surface 64*a* is shown as being generally vertical in the orientation of FIG. 6A. The angles of surfaces 64*b*, 64*c* are generally from about 15 to about 45 degrees. This is shown in FIG. 6A with respect to angle β.

The rotation-inhibiting projection 50 includes the first projection 60, the second projection 62 and the valley 64. The rotation-inhibiting projection 50 is in the shape of the general letter "C".

It is contemplated that the at least one rotation-inhibiting projection may contact at least one closure thread segments in another embodiment. For example, rotation-inhibiting projections may contact one or more of the closure thread segments. It is desirable in higher-pressured applications to maintain at least some venting channels to assist in releasing the pressure when opening the container.

As shown in FIG. 6A, the length L1 of the valley 64 is less than the lengths L2 and L3 of the rotation-inhibiting projections 60, 62. The length L1 is generally from about 0.025 inches to about 0.035 inches and, more specifically, from about 0.025 inches to about 0.030 inches. The length L2 is generally from about 0.055 inches to about 0.080 inches and, more specifically, from about 0.060 inches to about 0.075 inches. The length L3 is generally from about 0.055 inches to about 0.080 inches and, more specifically, from about 0.060 inches to about 0.075 inches. The length L4 is generally from about 0.030 inches to about 0.045 inches and, more specifically from about 0.030 inches to about 0.040 inches.

For example, a depth of the valley (e.g., length L1 in FIG. 6A) is generally less than 25% of the depth of a finish thread of the container. For example, if a finish thread is 60 mils, then the depth of the valley should be from 2 to 15 mils. The depth of the valley (e.g., length L1 in FIG. 6A) is generally from about 15 to about 20% of the depth of a finish thread of the container. For example, if a finish thread is 60 mils, then the depth of the valley should be from 9 to about 12 mils. The depth of the valley (e.g., length L1 in FIG. 6A) is generally from about 5 to about 25% of the depth of a finish thread of the container and, more specifically, from about 5 to about 20%. The depth of the valley (e.g., length L1 in FIG. 6A) is even more specifically from about 5% to about 15% of the depth of a finish thread of the container and, even more specifically, from about 10% to about 15%.

The rotation-inhibiting projection(s) of the present invention (e.g., rotation-inhibiting projection 50 in FIGS. 4A and 6A) is beneficial for several reasons. The rotation-inhibiting projection desirably uses less material, which reduces cost. The amount of material that forms the rotation-inhibiting projection to be displaced during the threading of the closure onto the container is reduced, which allows the rotation-inhibiting projection to retain more of its original shape. By having less material, the process of threading the closure onto the container is also improved, especially across a wider range of hand- and machine-application conditions. This produces a more consistent performance from package to package. The rotation-inhibiting projection also allows the process to use less torque in threading the closure onto the container.

The frangible connection 30 may be formed by molded-in-bridges in one embodiment. The molded-in-bridges are typically formed using a feature in the mold. In another embodiment, the frangible connection may be formed using scoring or scored lines, notches, leaders, nicks or other lines of weaknesses.

The closure 10 of the present invention may be used with a container 108 used to form a package 100 of FIGS. 2 and 3. Referring to FIG. 3, generally cross-sectional partial side views of the package 100 are shown. Specifically, FIG. 3 depicts a portion of the container 108 that includes a neck portion 102 that defines an opening. The neck portion 102 of the container 108 includes an external thread formation 140 and a continuous outer ring 110. The external thread formation 140 includes a first finish lead 142 and a second finish lead (not shown). The external thread formation 140 (first finish lead 142 and second finish lead) engages with the corresponding internal thread formation 40 (the closure thread segments 42, 44) to seal the package 100.

The first finish lead 142 begins near the open end of the container 108 and extends in a helical fashion to a second position that is closer to the closed end of the container.

Similarly, the second finish lead starts closer to the open end of the container 108 and extends in a helical fashion to a second position that is closer to the closed end of the container. Each of the first and second finish leads is continuous. The first positions of the first and second finish leads are typically located roughly 180 degrees apart from each other and, thus, begin on opposing sides of the neck portion 102 of the container 108. When opening the container 108, the first closure thread segment 42 is desirably in contact with the first finish lead 142 and the second closure thread segment 44 is desirably in contact with the second finish lead. It is contemplated that the external thread formation of the container may have discontinuous leads.

It is contemplated that the external thread formation of the container may be different than that disclosed with respect to the container 108.

The continuous outer ring 110 assists in positioning the tamper-evident band 20 if the annular skirt portion 14 is unthreaded from the neck 102 of the container 108 by the breaking of the frangible connection 30.

Figure 7A:
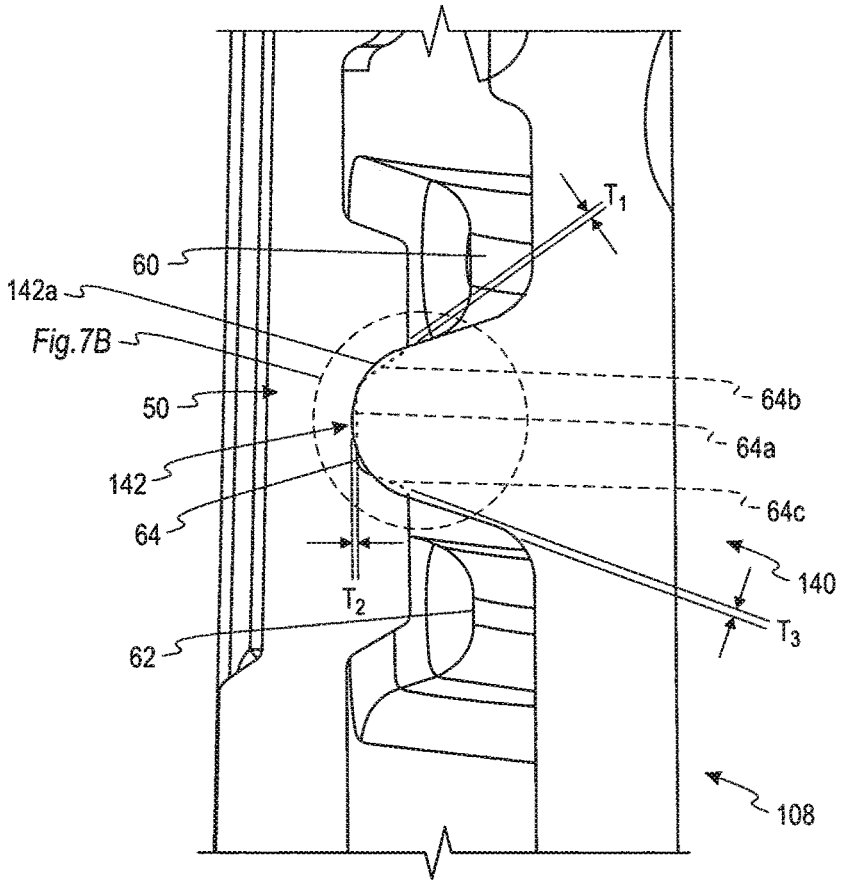
FIG. 7A is an enlarged cross-sectional partial side view without cross-hatching depicting interference between a rotating-inhibiting projection and a container finish according to one embodiment.
Figure 7B:
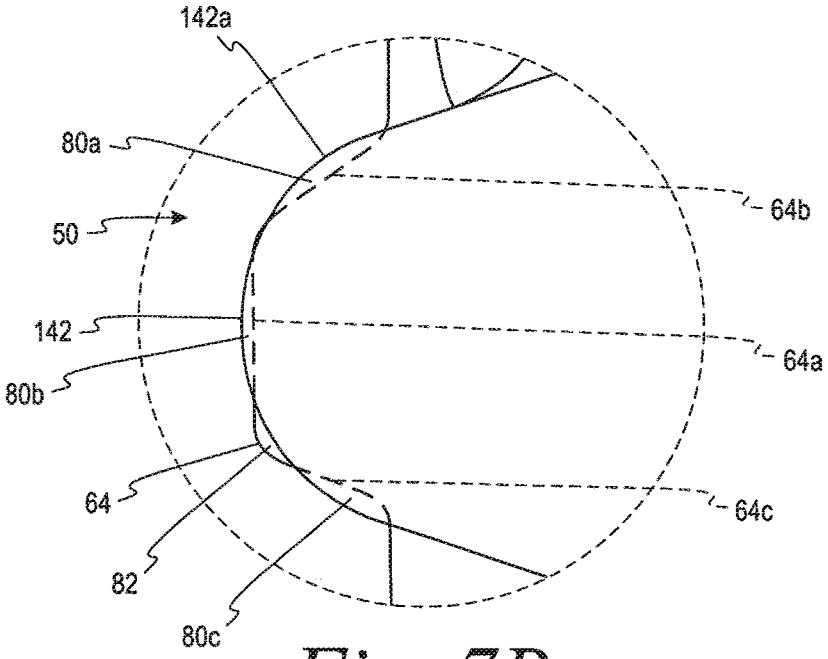
FIG. 7B is an enlarged view of generally circular area FIG. 7B in FIG. 7A.

A non-limiting example of interference of the surface area between a rotating-inhibiting projection and a container finish is shown in FIGS. 7A, 7B. FIG. 7A includes the external thread formation 140 with the first finish lead 142, and the rotating-inhibiting projection 50 with the first and second projections 60, 62 and the valley 64 therebetween. The portion of the original surfaces of the valley 64 (the surfaces 64*a*, 64*b*, and 64*c*) that are interfered by the first finish lead 142 are shown in dashed lines. These are the surfaces of the valley 64 before being contacted by an exterior surface 142*a* of the first finish lead 142. Referring back to FIG. 7B, the interferences of the surfaces 64*a*, 64*b*, and 64*c* are shown with respect to the exterior surface 142*a* in more detail. Specifically, there are three interference areas 80*a*, 80*b*, 80*c* shown in FIG. 7B. FIG. 7B also shows an open area 82 between the exterior surface 142*a* and the surfaces 64*a* and 64*b*. It is noted that on the initial threading of the first finish lead 142 into the rotating-inhibiting projection 50, excess material from the interference areas 80*b*, 80*c* will be displaced and assist in filling in the open area 82 such that this open area will not remain after the first finish lead 142 is threaded into the rotating-inhibiting projection 50.

The thickness T1 of interference area 80*a* at its maximum point in FIG. 7A is generally from about 0.0002 inches to about 0.0008 inches and, more specifically, from about 0.0003 inches to about 0.0006 inches. The thickness T2 of interference area 80*b* is generally from about 0.0002 inches to about 0.0008 inches and, more specifically, from about 0.0003 inches to about 0.0006. The thickness T3 of interference area 80*c* is generally from about 0.0002 inches to about 0.0008 inches and, more specifically, from about 0.0003 inches to about 0.0006 inches.

In one embodiment, the interference of the total amount of surface area of the rotating-inhibiting projection 50 (e.g., surfaces 64*a*, 64*b*, and 64*c* of FIG. 6A) to the finish of the container should be less than about 30% in one embodiment and less than about 20% or about 10% in other embodiments. Typically, the interference of the total amount of surface area of the rotating-inhibiting projection (e.g., surfaces 64*a*, 64*b*, and 64*c* of FIG. 6A) to the finish of the container ranges from about 10 to about 30% and, more specifically, from about 10 to about 25%. As discussed above, this assists in the rotation-inhibiting projection retaining more of its original shape, leads to less distortion and uses less polymeric material.

Figure 7C:
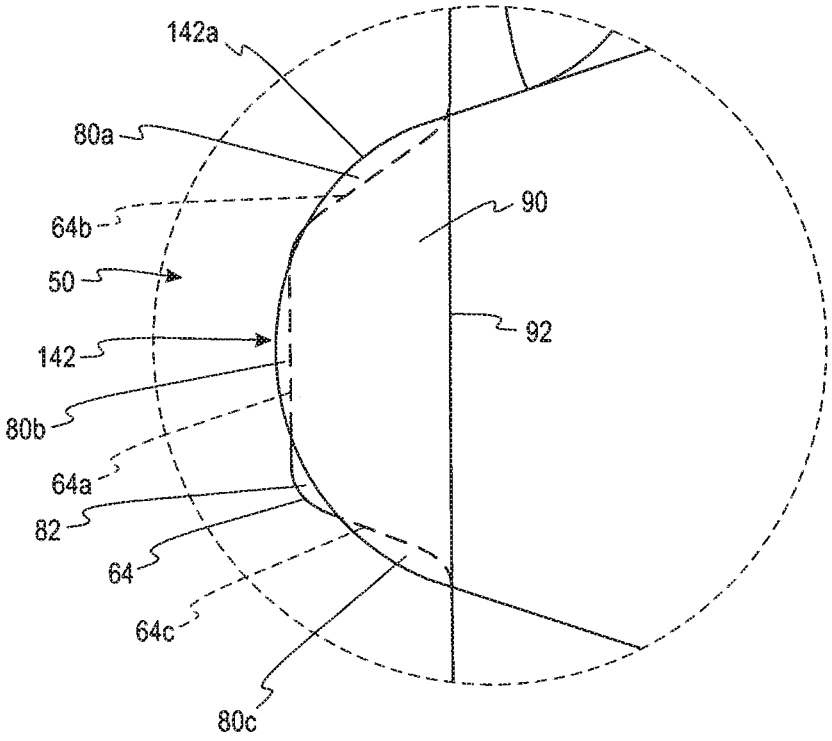
FIG. 7C is an enlarged view of generally circular area FIG. 7B in FIG. 7A showing interference of the total amount of surface area of the rotating-inhibiting projection to the finish of the container.

Referring to FIG. 7C, an example of how to calculate the interference of the total amount of surface area of the rotating-inhibiting projection 50 (e.g., surfaces 64*a*, 64*b*, and 64*c* of FIG. 6A) to the finish of the container is shown in one non-limiting example. FIG. 7C shows an area 90 that is bounded by an added line 92 and the exterior surface 142*a* of the first finish lead 142. The total amount of interference in areas 80*a*, 80*b* and 80*c* are added up and divided by the area 90. This gives the interference of the total amount of surface of the rotating-inhibiting projections to the finish of the container.

The closures of the present invention may include an oxygen-scavenger material. This oxygen-scavenger material may be distributed within the closure or may be a separate layer. The oxygen-scavenger material may be any material that assists in removing oxygen within the container, while having little or no effect on the contents within the container.

Alternatively, or in addition to, the closures may include an oxygen-barrier material. The oxygen-barrier material may be added as a separate layer or may be integrated within the closure itself. The oxygen-barrier materials assist in preventing or inhibiting oxygen from entering the container through the closure. These materials may include, but are not limited to, ethylene vinyl alcohol (EVOH). It is contemplated that other oxygen-barrier materials may be used in the closure.

Additionally, it is contemplated that other features may be included in the closure described above. For example, U.S. Publication No. 2018/009979, U.S. Publication No. 2017/0349336, U.S. Pat. Nos. 9,126,726, 9,085,385, 8,763,830, 8,485,374, U.S. Publication No. 2009/0045158 and U.S. Pat. No. 6,123,212 all include features that may be incorporated in the closures of the present invention. All of these references are hereby incorporated by reference in their entireties.

The top wall portion 12, the annular skirt portion 14, and the tamper-evident band 20 are made of polymeric material. The top wall portion 12, the annular skirt portion 14, and the tamper-evident band 20 are typically made of an olefin (e.g., polyethylene (PE), polypropylene (PP)), polyethylene terephthalate (PET) or blends thereof. One example of a polyethylene that may be used in high density polyethylene (HDPE). It is contemplated that the top wall portion, the annular skirt portion, the tamper-evident band may be made of other polymeric materials. The tamper-evident band 20 is typically made of the same materials as the top wall portion 12, and the annular skirt portion 14.

The closures are typically formed by processes such as injection or compression molding, extrusion or the combination thereof.

The container 108 is typically made of polymeric material. One non-limiting example of a material to be used in forming a polymeric container is polyethylene terephthalate (PET), polypropylene (PP) or blends using the same. It is contemplated that the container may be formed of other polymeric or copolymer materials. It is also contemplated that the container may be formed of glass. The container 108 typically has an encapsulated oxygen-barrier layer or oxygen barrier material incorporated therein.

To open the container 108 and gain access to the product therein, the closure 10 is unthreaded by turning the closure 10 with respect to the container 108. After the closure has been unthreaded, the closure 10 can be removed from the container 108. When using this method, the tamper-evident band 20 is at least partially separated from the reminder of the closure 10 via the frangible connection 30, which indicates that the closure 10 has been unthreaded with respect to the container 108.

The polymeric closures of the present invention are desirable in both low-temperature and high-temperature applications. The polymeric closures may be used in low-temperature applications such as an ambient or a cold fill. These applications typically include pressurized products such as carbonated soft drinks. It is contemplated that the closure may be used in other applications such as water, sports drinks, and aseptic applications such as dairy products. It is contemplated that other low-temperature applications may be used with the polymeric closures of the present invention.

The polymeric closures of the present invention may be exposed to high-temperature applications such as hot-fill, pasteurization, and retort applications. A hot fill application is generally performed at temperatures around 185° F., while a hot-fill with pasteurization is generally performed at temperatures around 205° F. Retort applications are typically done at temperatures greater than 250° F. It is contemplated that the polymeric closures of the present invention can be used in other high-temperature applications.

What is claimed is:

1. A closure comprising:

a first closure portion including:

a polymeric top wall portion;

a polymeric annular skirt portion depending from the polymeric top wall portion, the annular skirt portion including an exterior surface and an interior surface, the interior surface of the annular skirt portion including (a) an internal thread formation for mating engagement with an external thread formation of a container and (b) at least one rotation-inhibiting projection, the at least one rotation-inhibiting projection being located to contact the external thread formation of the container, the at least one rotation-inhibiting projection being in the general cross-sectional shape of the letter "C" prior to engagement with the external thread formation of the container; and a second closure portion including:

a polymeric tamper-evident band depending from and being at least partially detachably connected to the polymeric annular skirt portion by a frangible connection, wherein the closure has an unopened position and an opened position, the opened position occurring when the tamper-evident band has been at least partially broken from the polymeric annular skirt portion.

2. The closure of claim 1, wherein the at least one rotation-inhibiting projection is a plurality of rotation-inhibiting projections.

3. The closure of claim 2, wherein the plurality of rotation-inhibiting projections is from about 4 to about 6 rotation-inhibiting projections.

4. The closure of claim 1, wherein the at least one rotation-inhibiting projection is located generally axially to the internal thread formation.

5. The closure of claim 1, wherein the at least one rotation-inhibiting projection is spaced from the internal thread formation.

6. The closure of claim 1, wherein the internal thread formation includes a first closure lead and a second closure lead.

7. The closure of claim 1, wherein the closure is a one-piece closure.

8. The closure of claim 1, wherein the closure comprises polyolefins.

9. The closure of claim 1, wherein the first closure portion further includes a polymeric continuous plug seal depending from the polymeric top wall portion, the continuous plug seal being spaced from an interior surface of the polymeric annular skirt portion.

10. The closure of claim 1, wherein the first closure portion further includes a polymeric outer seal depending from the polymeric top wall portion.

11. A closure comprising:

a first closure portion including:

a polymeric top wall portion;

a polymeric annular skirt portion depending from the polymeric top wall portion, the annular skirt portion including an exterior surface and an interior surface, the interior surface of the annular skirt portion including (a) an internal thread formation for mating engagement with an external thread formation of a container and (b) at least one rotation-inhibiting projection, the at least one rotation-inhibiting projection being located to contact the external thread formation of the container, the at least one rotation-inhibiting projection having a cross-sectional shape including a first projection, a second projection and a valley located between the first and second projections prior to engagement with the external thread formation of the container, the projections extending from the interior surface of the annular skirt portion; and a second closure portion including:

a polymeric tamper-evident band depending from and being at least partially detachably connected to the polymeric annular skirt portion by a frangible connection, wherein the closure has an unopened position and an opened position, the opened position occurring when the tamper-evident band has been at least partially broken from the polymeric annular skirt portion.

12. The closure of claim 11, wherein the at least one rotation-inhibiting projection is a plurality of rotation-inhibiting projections.

13. The closure of claim 12, wherein the plurality of rotation-inhibiting projections is from about 4 to about 6 rotation-inhibiting projections.

14. The closure of claim 11, wherein the at least one rotation-inhibiting projection is located generally axially to the internal thread formation.

15. The closure of claim 11, wherein the at least one rotation-inhibiting projection is spaced from the internal thread formation.

16. The closure of claim 11, wherein the closure comprises polyolefins.

* * * * *